US006592278B1

(12) United States Patent
Holthaus

(10) Patent No.: US 6,592,278 B1
(45) Date of Patent: Jul. 15, 2003

(54) CREAM AND DEODORANT DISPENSER

(75) Inventor: Ulrike Holthaus, Pulheim (DE)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 10/049,225

(22) PCT Filed: Apr. 14, 2000

(86) PCT No.: PCT/EP00/03385

§ 371 (c)(1),
(2), (4) Date: Mar. 8, 2002

(87) PCT Pub. No.: WO00/64303

PCT Pub. Date: Nov. 2, 2000

(51) Int. Cl.[7] ..... B43K 21/18

(52) U.S. Cl. ..... 401/66; 401/65; 401/79; 401/175; 401/171

(58) Field of Search ..... 401/171, 172, 401/173, 174, 175, 68, 70, 86, 65, 66, 79, 67; 222/390, 391

(56) References Cited

U.S. PATENT DOCUMENTS 5,573,341 A * 11/1996 Iaia ..... 401/172
5,725,133 A * 3/1998 Iaia ..... 222/390
5,839,622 A 11/1998 Bicknell et al. ..... 222/390

FOREIGN PATENT DOCUMENTS

| | | |
|---|---|---|
| DE | 297 15 402 | 12/1998 |
| EP | 0 312 165 | 4/1989 |
| EP | 0 787 445 | 8/1997 |

* cited by examiner

*Primary Examiner*—David J. Walczak
(74) *Attorney, Agent, or Firm*—Stephen D. Harper; Gregory M. Hill

(57) ABSTRACT

A dispenser for dispensing a material and a method of use thereof. The dispenser includes a chamber with a discharge opening for holding and dispensing a material, a spindle located in the chamber, capable of being rotated, a rotatable toothed wheel located outside the chamber that is connected to the spindle to permit rotation of the spindle, and a moveable piston, connected to the spindle, for supporting and dispensing the material. The dispenser also includes at least one actuating button located on the dispenser, having a pusher element for rotating the toothed wheel, and at least one pusher deflector for deflecting the pusher element out of engagement with the toothed wheel. The pusher deflector permits the material to be pushed back into the dispenser after use by disengaging the pusher element with the toothed wheel. The dispenser is particularly useful for dispensing a deodorant, gel, or cream.

17 Claims, 4 Drawing Sheets

CREAM AND DEODORANT DISPENSER

CROSS REFERENCE TO RELATED APPLICATIONS

This application is a national stage application under 35 U.S.C. § 371 of international application PCT/EP00/03385 filed on Apr. 14, 2000, the international application not being published in English. This application also claims priority under 35 U.S.C. §119 to DE 199 18 410.0, filed on Apr. 23, 1999 and DE 199 21 662.2, filed on May 11, 1999.

FIELD OF THE INVENTION

The invention relates to a dispenser packaging for a cream-like mass or a mass ripped away by wiping a surface, comprising a chamber with a delivery opening for receiving and storing the mass, a spindle longitudinally axially and rotatably arranged in the chamber, a piston movable in the chamber along the spindle, a toothed wheel arranged outside the chamber in fixed rotational connection with the spindle, and at least one actuating button, which is arranged at the dispenser packaging, with a moulded on pusher element, wherein the at least one actuating button together with the pusher element is arranged to be movable in such a manner relative to the toothed wheel from a rest setting into an end setting and back that on actuation of the actuating button from the rest setting into the end setting the pusher element goes into engagement with a tooth of the toothed wheel and rotates this.

BACKGROUND OF THE INVENTION

Dispenser packagings of that kind, in which the user actuates a button while holding the packaging in hand and this button actuation sets a spindle in rotation, which leads to delivery of product from the dispenser packaging, are used for the dispensing of cream or as a deodorant stick.

A dispenser packaging according to this category is known from U.S. Pat. No. 5,839,622. This dispenser packaging comprises a toothed wheel which is connected with a spindle for the advance of a piston and which has teeth at its circumferential surface. A pusher element of an actuating button engages in these teeth in the case of its inwardly directed forward movement from its rest setting into its end setting and thus rotates the toothed wheel through a limited travel. In its end setting the pusher element remains in engagement with the toothed wheel surface. In addition, the toothed wheel has, at its underside front edge surface, further teeth which are formed in correspondence with ramp-shaped teeth at an element in the base region of the prior known dispenser packaging and on rotation of the toothed wheel slide on their ramp surfaces bearing against one another. After reaching the highest point of the ramp surface of the element arranged at the base side, the toothed wheel jumps, under the pressure of a spring, to the succeeding ramp-shaped toothed element. If the user now releases the actuating button, this moves back into its rest setting, whereby the pusher element comes out of engagement with the toothed wheel. A return rotation of the toothed wheel against the rotational direction effected by the pusher element of the actuating button is prevented by the mutually contacting projecting edges of the ramp-shaped teeth.

In the case of this prior known dispenser packaging a return movement of the piston against the rotational direction of the spindle for the toothed wheel is thus not possible not only when the actuating button is pressed, because the pusher element of the actuating button then engages in the toothed wheel, but also when the actuating button is disposed in rest setting, because the teeth of the toothed wheel at the front edge side then stand in engagement with the respective counterpart thereof.

There against, the invention has the object of creating a solution which enables return movement of the piston against the spindle rotational direction driven by the pusher.

SUMMARY OF THE INVENTION

In a dispenser packaging of the kind denoted in the introduction this object is met by the dispenser packaging having at least one pusher deflector against which the at least one pusher element abuts before reaching the end setting and which deflects the pusher element out of engagement with the toothed wheel.

It is thereby achieved that the pusher element in its forward movement directed inwardly of the packaging, after it has rotated the toothed wheel through a specific angular setting, is lifted by the pusher deflector out of its engaged setting with the toothed wheel. This now enables, in the pressed setting of the actuating button into its end setting, a return displacement of the piston and thus a rotation of the spindle and the toothed wheel against the rotational direction driven by the pusher. Thus, for example in the case of a deodorant stick, any mass protruding beyond the delivery opening of the dispenser packaging can be pressed back into the dispenser packaging.

In order to ensure that the pusher element initially goes securely into engagement with the toothed wheel, but nevertheless a lifting out is possible before reaching the end setting, the invention proposes in an advantageous development that the pusher element consists of a web-shaped or rod-shaped base body with a moulded-on nose facing the teeth of the toothed body and a deflector web disposed at a spacing from the nose and directed oppositely to the direction of the nose.

It is advantageous for manipulating the actuating button if the actuating button and the pusher element are resiliently arranged and/or intrinsically resiliently constructed in such a manner that the actuating button together with the pusher element automatically moves back out of the end setting into the rest setting. In particular, it is of advantage if the actuating button and the pusher element are constructed to be inherently resilient, so that they automatically move back out of the end setting into the rest setting. This simplifies the constructional cost of the dispenser packaging, as a restoring spring is then not necessary.

In further refinements, the invention alternatively proposes that either the tooth edges of the teeth of the toothed wheel are oriented parallel to the spindle longitudinal axis and the pusher element scans the toothed wheel tangentially or that the tooth edges of the teeth of the toothed wheel are oriented perpendicularly to the spindle longitudinal axis and the pusher element scans the toothed wheel radially.

According to a development of the invention it is of advantage for ergonomic handling of the dispenser packaging if two diametrically oppositely disposed actuating buttons with pusher elements are arranged at the dispenser packaging, wherein on actuation of the actuating buttons the elements substantially simultaneously come into engagement with the toothed wheel at diametrically opposite regions thereof.

Advantageously and equally proposed by the invention, in this embodiment a pusher deflector is associated with each pusher element.

In order to facilitate return pressing of the piston against the spindle rotational direction driven by the pusher it is of advantage if the spindle has a thread inclination of 45°.

In order that a pushing back of the piston and the associated rotational movement of spindle and toothed wheel against the rotational direction driven by the pusher are possible only in the case of intentional use by the user, the invention finally proposes that the nose of each pusher element in the rest setting of the actuating button engages with the toothed wheel in a manner preventing return rotation of the toothed wheel against the button actuating direction. It is thereby achieved that pushing back of the piston is possible exclusively when the actuating button or actuating buttons is or are pressed into the end setting thereof.

The invention is described in more detail in the following by way of example with reference to the drawings.

DETAILED DESCRIPTION OF THE INVENTION

Figure 2:
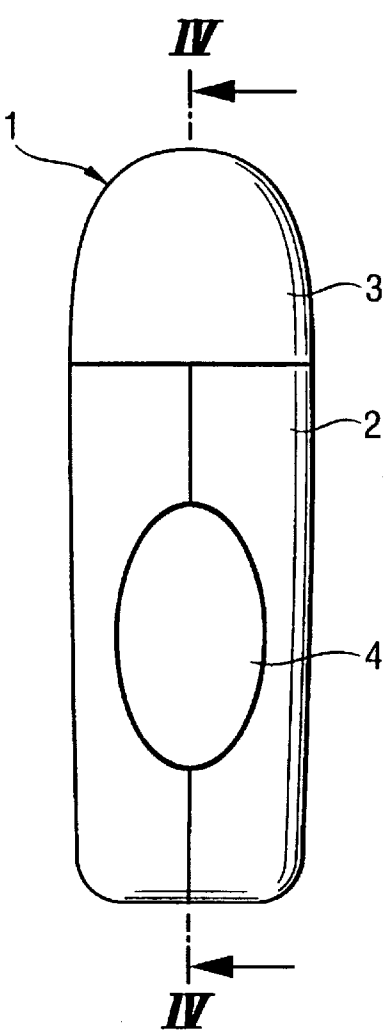
FIGS. 1 and 2 show front and side views, respectively, of a dispenser packaging according to the invention.
Figure 1:
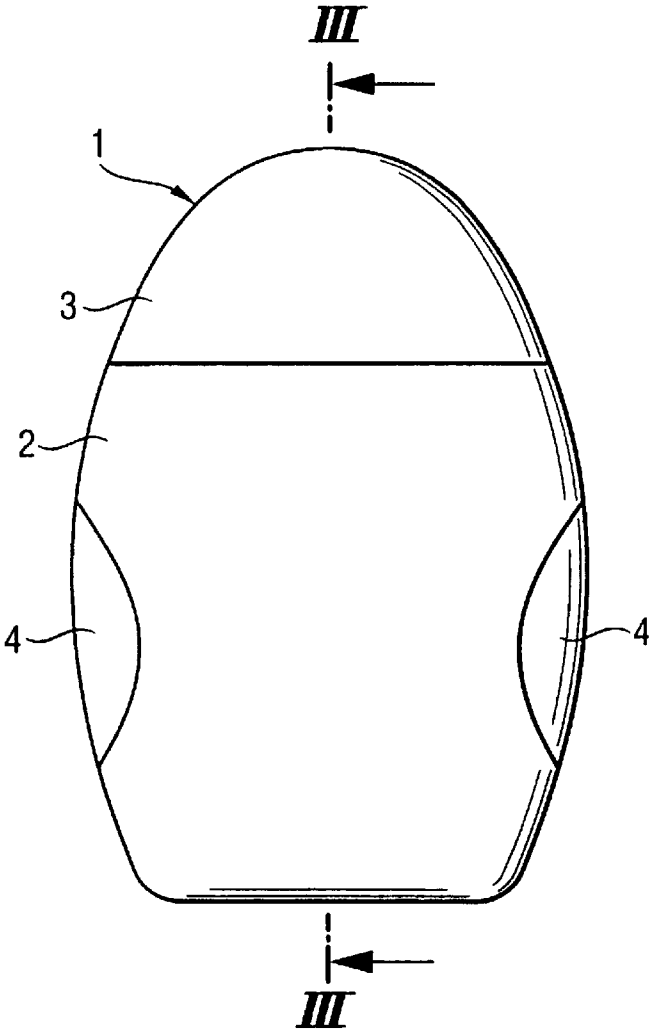

The dispenser packaging denoted in its entirety by 1 in FIGS. 1 and 2 consists of an outer case 2 with a removable cover at the upper end. Both cover 3 and outer case 2 are of oval profile in cross-section. Two diametrically opposite openings are formed in the side surfaces of the outer case 2 and are each penetrated by a respective actuating button 4 from the inner side of the dispenser packaging 1. The surfaces of the actuating buttons 4 penetrating the openings terminate flushly and the contours thereof continue the adjoining outer surfaces of the outer case 2.

Figure 3:
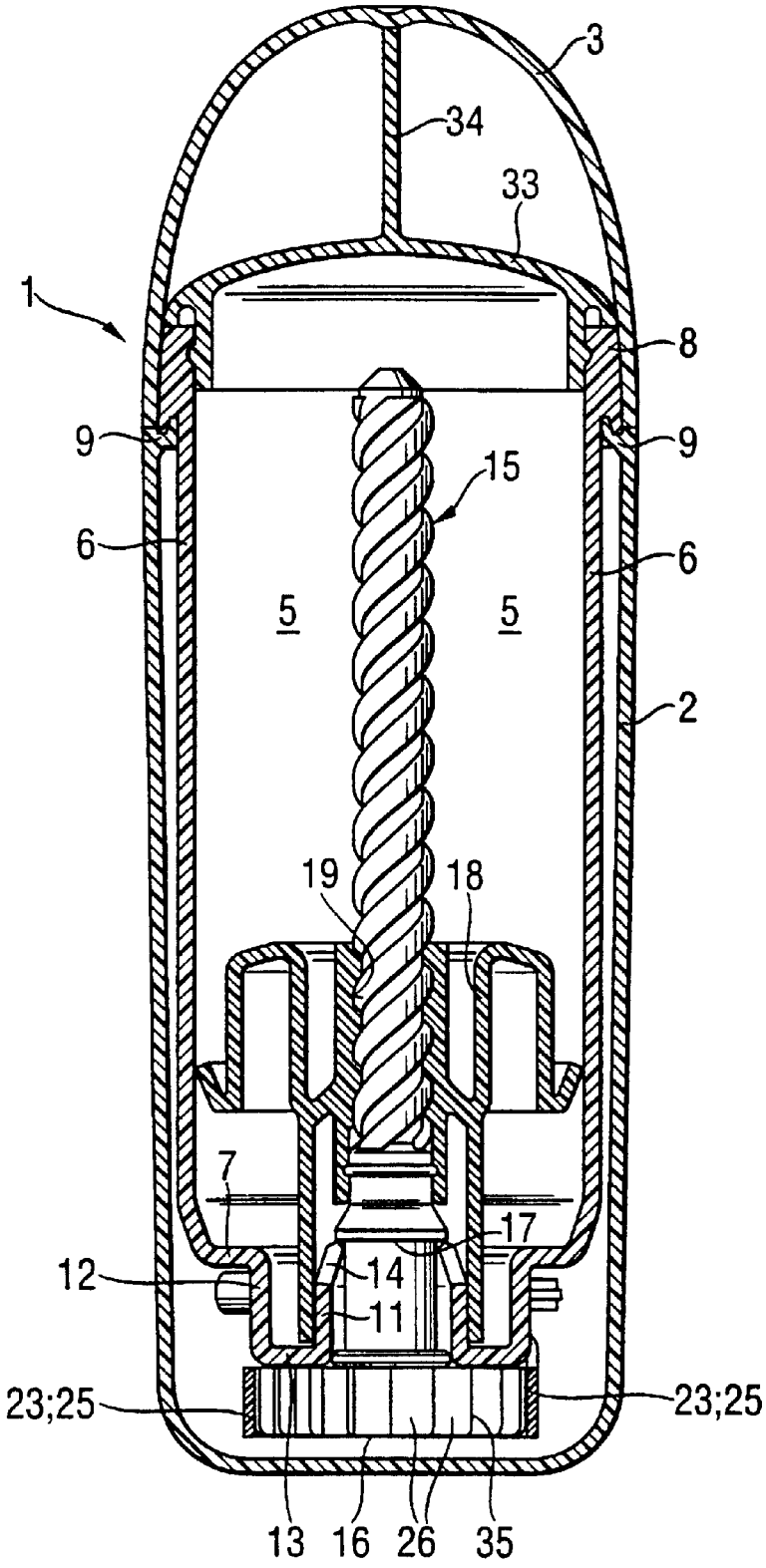
FIG. 3 shows a cross sectional view, along the line III—III in FIG. 1, with illustration of the spindle and toothed wheel in side view.
Figure 4:
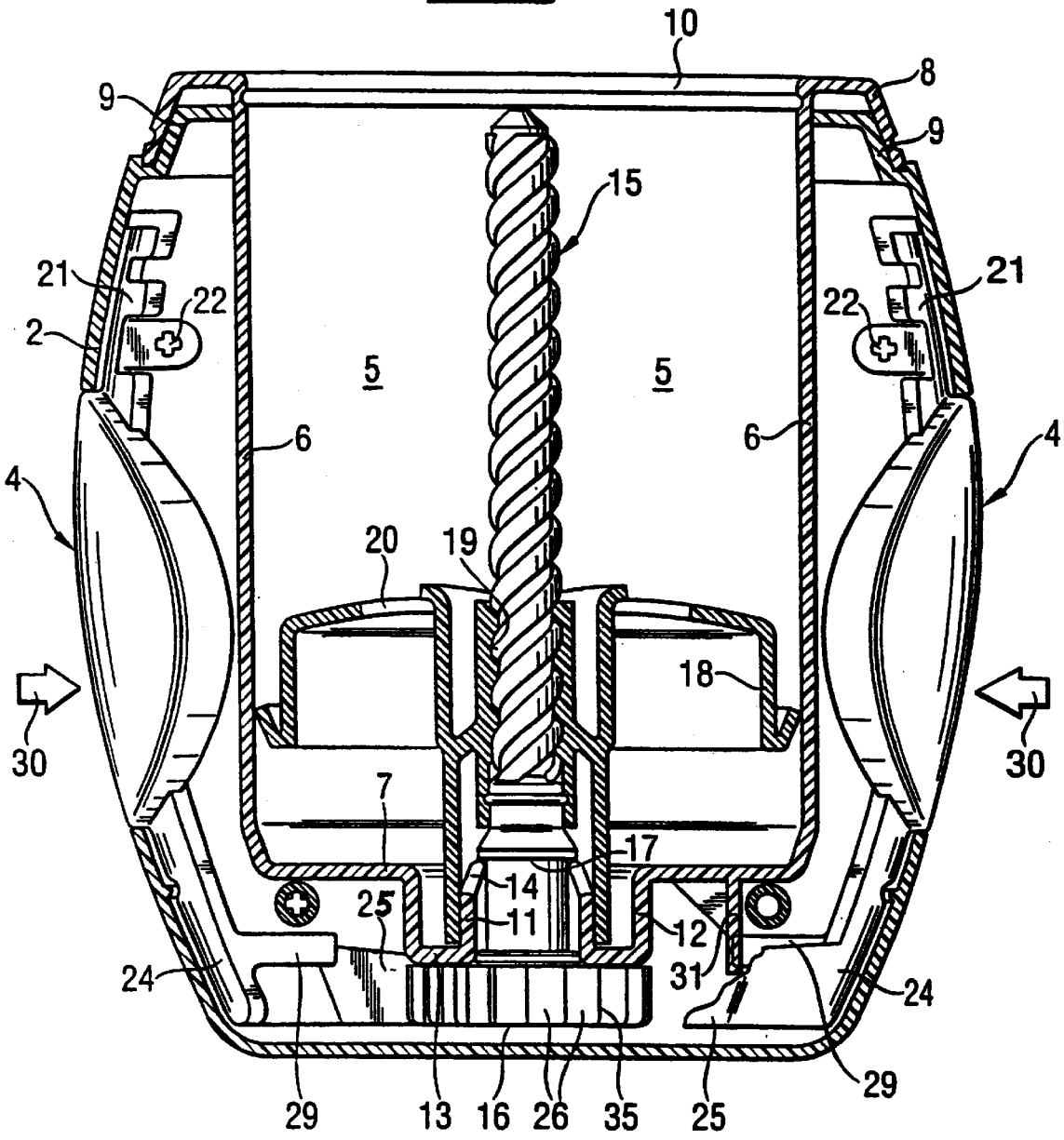
FIG. 4 shows a partial sectional view, along the line IV—IV in FIG. 2, with illustration of the spindle, the toothed wheel and actuating buttons in side view.
Figure 5:
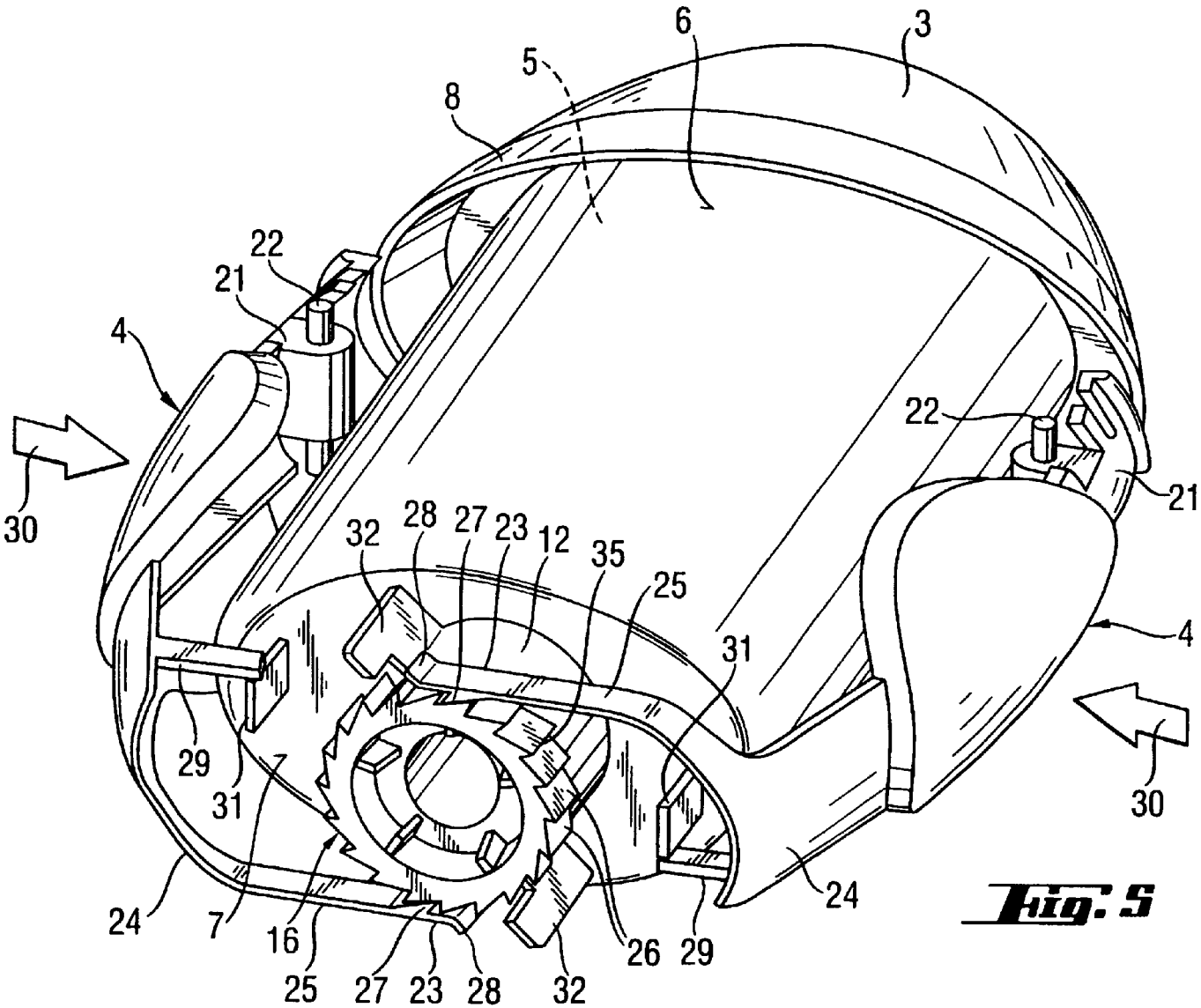
FIG. 5 shows a perspective view of part of the inside of the dispenser packaging of FIG. 1.

As is apparent from FIGS. 3 and 4, a chamber 5 is arranged within the outer case 2. The chamber 5 is bounded by side walls 6, which are similarly arranged to be oval-shaped in cross-section, and by a base surface 7. An encircling, protruding apron 8 is moulded onto the side surfaces 6 at the upper end on the side remote from the base surface 7. The apron 8 has at its ends directed towards the actuating buttons 4 a greater spacing from the side surfaces 6 than from the longitudinal sides thereof. The apron 8 engages over an edge region 9, which is provided partly with incisions, of the outer case 2 in such a manner that the chamber 5 is thereby attached to the upper edge region of the outer case 2. Altogether, the chamber 5 is pushed into the outer case 2 which has an opening at the upper end and a base at the lower end. The apron 8 surrounds a delivery opening 10 of the chamber 5.

An opening is formed centrally and axially in the base surface 7. This opening is surrounded by a first cylinder wall 11. The first cylinder wall 11 is surrounded by a second, circular cylinder wall 12 at a spacing. The first cylinder wall 11 and the second cylinder wall 12 are connected together by a circularly annular base surface 13. The second cylinder wall 12 is in turn connected with the base surface 7 of the chamber 5, so that the second cylinder wall 12 and the surface 13 together form a cup-shaped depression in the base surface 7. The edge region 14, which faces the chamber 5, of the first cylinder wall 11 is formed to be inclined slightly inwardly and is divided into individual, in the present case four, segments by incisions. These segments bear against an undercut 17 of a spindle 15, which penetrates the opening and the chamber 5 and is arranged in the chamber 5 to be longitudinally axial and rotatable. A toothed wheel 16 is arranged, on its side remote from the chamber 5, at the spindle 15 to be in fixed rotational connection with the spindle 15, in the present case moulded onto the spindle 15. The region of the undercut 17 and the surface, which faces the chamber 5, of the toothed wheel 16 are thereby spaced apart in such a manner that the spindle is secured by the edge region 14 and the circularly annular base surface 13 of the chamber 5 against longitudinally axial movement. In the present example the thread turns of the spindle 15 have an inclination of 45°. This is advantageous for the form of embodiment, which is illustrated here, of a deodorant stick when through application of an external force, as subsequently explained in more detail, the user wishes to manually press back withdrawn mass or a piston 18 into the chamber 5. The thread turns of the spindle 15 can, however, readily also have other inclinations, for example 20°.

The piston 18 is arranged within the chamber 5 and has a central opening 19 with threads, by means of which it is movable back and forth in the chamber 5 by rotational movement of the spindle 15. In the embodiment the piston is a through flow piston having openings 20 into which mass, introduced in liquid state into the chamber 5, can penetrate in order to produce a good anchorage of the piston in the mass after cooling and hardening of the mass. This embodiment is particularly advantageous for the application of deodorant mass for production of the dispenser packaging 1 as a deodorant stick. In the case of cream-like or gel-like mass stored in the chamber 1, a piston, which is closed at the outer side, without openings 20 is expediently used.

The actuating buttons 4 have fastening webs 21 which are oriented in direction towards the delivery opening 10 and which represent the fastening of the actuating buttons 4 to the outer case 2 in a manner enabling rotational movement about a rotational axle 22. The rotational axles 22 form the fulcrum of the actuating buttons 4 constructed overall as a lever. The other side of the lever is formed by pusher elements 23 which are each connected by way of a respective fastening web 24 with the respective actuating button 4. The pusher elements 23 each consist of a web-shaped or rod-shaped base body 25 which is moulded onto the respective one of the fastening webs 24. A nose 27, which by its tip faces the toothed wheel 16 for engagement between individual teeth 26 of the toothed wheel 16, is moulded onto each of the base bodies 25. A deflector web 28 is then formed at the end of the respective pusher element 23, preferably constructed integrally with the pusher element, at a further spacing from the respective fastening web 24 than the respective nose 27. In that case the deflector webs 28 each project by angled extension from the surface of the pusher element 23 in the direction opposite to the tip of the nose 27.

The actuating button 4 together with all its elements 21, 23, 24, 25, 27, 28 and 29 is produced as a whole in one piece from plastics material. The arrangement, and mounting of the actuating button at the rotational axle 22 connected with the outer case 2 is oriented in such a manner that in the rest setting of the actuating buttons as illustrated in the drawings the pusher elements 23 bear tangentially against the toothed wheel 16 or are oriented tangentially to the toothed wheel 16 at a small spacing therefrom, wherein the noses 27 each engage in the intermediate space formed by two teeth 26 of the toothed wheel 16.

In addition, short guide webs 29 extend out from the fastening webs 24. On actuation of the actuating buttons 4 in the direction of the arrows 30 the guide webs 29 slide along guide segments 31 standing out from the base surface 7. It is thereby ensured that the actuating buttons 4 when actuated are moved in guided manner from their rest setting in direction of the arrows 30 into their end setting.

Two diametrically opposite pusher deflectors 32 extending parallel to the teeth 26 of the toothed wheel 16 protrude from the second cylinder wall 12 and the base surface 7. The side surface, which faces the respective deflector web 28, of the pusher deflector 32 is arranged at an angle to the principal geometric axes of the base surface 7, which angle corresponds with the inclination and angle of the deflector web 28 relative to the pusher base body 25.

The delivery opening 10 is closed by a cover element 33 which sealingly bears against the side walls 6 by a web-shaped edge region and which has a dished cover region. The cover element 33 bears by a web-shaped ridge 34 against the inner side of the cover 3, which attaches the cover element 33 to the dispenser packaging 1 by engaging over in friction seating with the apron 8 and impact abutment relative to the outer case 2.

If the dispenser packaging 1 is to be provided for dispensing cream-like or gel-like mass, the cover element 33 can be provided with slot-shaped openings, which are not illustrated, and during the actuation of the dispenser device 1 remain on the delivery opening 10, where against the cover element 33 in the case of use as a deodorant stick, as illustrated in the embodiment, has to be removed together with the cover 3 from the delivery opening 10 or the outer case 2.

The dispenser packaging 1 is filled through the delivery opening 10 with liquid deodorant mass, which hardens after putting on the cover element 33 in the overhead setting of the dispenser packaging 1, or with a cream-like or gel-like mass.

In the case of application or use, the user actuates the actuating buttons 4 in the direction of the arrows 30. The pusher elements 23 are thereby equally moved in the direction of the arrows 30, hit by their noses 27 against teeth 26 of the toothed wheel 16 and rotate this until the deflector webs 28 then strike the inclined surfaces of the pusher deflectors 32 and the pusher elements 23 are deflected by virtue of their inherent resilience in such a manner at the pusher deflectors 32 that the noses 27 come out of engagement with teeth 26 of the toothed wheel 16. The deflecting or diverting movement of the deflector webs 28 on the pusher deflectors 32 is continued until the fastening webs 24 of the actuating buttons 4 come into abutment with the guide segments 31 and a further, inwardly directed pivotation or movement of the actuating buttons 4 in the direction of the arrows 30 is thereby stopped. This is the end setting of the actuating buttons 4 constructed as a lever. Due to the rotation of the toothed wheel 16 effected by the movement of the actuating buttons 4 from the rest setting into the end setting, the spindle 15, which is connected in rotationally fixed manner therewith, is rotated at the same time and the piston 18 has been moved in direction towards the delivery opening 10. By virtue of this piston movement the mass disposed in the chamber 5 has been transported beyond the opening edge.

If the user now releases the actuating buttons, then these automatically move back into the rest setting illustrated in the figures by virtue of their inherent resilience as well as the fact that the fastening webs 21, which are formed above the rotational axles 22, bear against the inner side of the outer case 2 and thereby on movement of the actuating buttons 4 to the end setting a rearward torque, or a corresponding force, directed against this movement is exerted by the fastening webs 21. The user does not need to release the actuating buttons 4 for this purpose, as it is also sufficient if when grasping the buttons by hand the user no longer exerts force in the direction of the arrows 30. After reaching the rest setting, a renewed actuation of the actuating buttons 4 can be carried out by the user. This actuation can be continued by the user until, by means of the piston advance, product quantities corresponding to the user's wishes have exited from the delivery opening 10 or, in the case of a deodorant mass, until the deodorant stick protrudes to sufficient extent beyond the rim of the delivery opening 10. If the user wants to guide this protruding mass back into the chamber 5, the user presses the actuating buttons 4 until these have reached their end setting by abutment of the fastening webs 24 against guide segments 31, then places the cover element 33 on the deodorant mass and pushes this back into the chamber 5 with light application of pressure. By virtue of the 45° thread of the spindle and the fact that the pusher elements 23 in the end setting do not stand in engagement with teeth 26 of the toothed wheel 16, the piston 18 can move back into the chamber 5 under rearwardly directed rotation of spindle 15 and toothed wheel 16.

Whereas in the case of the illustrated embodiment the tooth edges 35 of the teeth 26 of the toothed wheel 16 are oriented parallel to the spindle longitudinal axis and the pusher elements 23 scan the toothed wheel 16 tangentially, it is also possible to provide the tooth edges of the teeth of the toothed wheel perpendicularly to the spindle axis on the surface of the toothed wheel parallel to the base surface 7 and then let the pusher elements radially engage in the teeth.

Moreover, the noses 27 are arranged at the pusher elements 23 in such a manner that in the rest setting of the actuating buttons 4 at least one nose 27 bears against a tooth edge 35 and thus prevents a return rotation of the toothed wheel 16 against the movement direction of the actuating buttons 4.

What is claimed is:

1. A dispenser for dispensing a material comprising:

(a) a chamber for storing a material and having a delivery opening for dispensing the material;

(b) a spindle arranged in a longitudinal axial direction in the chamber wherein the spindle is capable of being rotated;

(c) a rotatable toothed wheel having teeth with edges, wherein the toothed wheel is located outside the chamber and is in fixed connection with the spindle to permit rotation of the spindle;

(d) a moveable piston, wherein the piston is in contact with the spindle in a manner to permit movement of the piston within the chamber as the spindle rotates;

(e) at least one actuating button located on the dispenser and having attached thereto, either directly or indirectly, a pusher element for rotating the toothed wheel, wherein the actuating button and pusher element have a rest setting and an end setting, and wherein the actuating button and pusher element are arranged so that upon actuation of the actuating button from the rest setting to the end setting, the pusher element engages a tooth of the toothed wheel to rotate the toothed wheel; and (f) at least one pusher deflector for deflecting the pusher element out of engagement with the toothed wheel before reaching the end setting.

2. The dispenser of claim 1 wherein the pusher element comprises (i) a web-shaped or rod-shaped base body having a nose that faces the teeth of the toothed wheel and (ii) a deflector web for contacting the pusher deflector wherein the deflector web is arranged at a spacing from the nose and is in a direction opposite to the direction of the nose.

3. The dispenser of claim 2 wherein the actuating button and the pusher element are resiliently arranged or intrinsically resiliently constructed, or both, so that the actuating button together with the pusher element automatically moves out of the end setting and into the rest setting upon release of the actuating button.

4. The dispenser of claim 1 wherein the edges of the teeth of the toothed wheel are oriented parallel to the longitudinal axis of the spindle and the pusher element bears against the toothed wheel tangentially.

5. The dispenser of claim 1 wherein the edges of the teeth of the toothed wheel are oriented perpendicularly to the longitudinal axis of the spindle and the pusher element bears against the toothed wheel radially.

6. The dispenser of claim 1 wherein the dispenser comprises two actuating buttons that are diametrically opposite to each other, and wherein each actuating button has attached thereto either directly or indirectly, a pusher element, wherein the pusher elements, on actuation of the actuating buttons, move substantially simultaneously to engage the toothed wheel at diametrically opposing regions of the toothed wheel.

7. The dispenser of claim 6 wherein each of the pusher elements has associated with it a pusher deflector.

8. The dispenser of claim 7 wherein the spindle has a thread inclination of 45°.

9. The dispenser of claim 7 wherein the pusher element comprises a nose that in the rest setting contacts the toothed wheel in a manner to prevent rotation of the toothed wheel in a direction opposite to the rotation direction during activation of the activating button.

10. The dispenser of claim 1 wherein the material is a deodorant stick.

11. A method of dispensing a material from a dispenser comprising:

(a) providing a dispenser comprising
  (i) a chamber for storing a material and having a delivery opening for dispensing the material;
  (ii) a spindle located in the chamber wherein the spindle is capable of being rotated;
  (iii) a rotatable toothed wheel, wherein the toothed wheel is located outside the chamber and permits rotation of the spindle;
  (iv) a moveable piston for supporting and moving the material to be dispensed;
  (v) at least one actuating button located on the dispenser and having attached thereto, either directly or indirectly, a pusher element for rotating the toothed wheel, wherein the actuating button and pusher element have a rest setting and an end setting; and
  (vi) at least one pusher deflector;
(b) actuating the actuating button and engaging the pusher element with the toothed wheel to rotate the toothed wheel and move the material towards the delivery opening;
(c) contacting the pusher element with the pusher deflector to disengage the pusher element with the toothed wheel before reaching the end setting; and
(d) dispensing material through the delivery opening.

12. The method of claim 11 wherein the actuating button and the pusher element are resiliently arranged or intrinsically resiliently constructed, or both, so that the actuating button together with the pusher element automatically moves out of the end setting and into the rest setting upon release of the actuating button.

13. The method of claim 11 wherein the dispenser comprises two actuating buttons that are diametrically opposite to each other, and wherein each actuating button has attached thereto either directly or indirectly, a pusher element, wherein the pusher elements, on actuation of the actuating buttons, move substantially simultaneously to engage the toothed wheel at diametrically opposing regions of the toothed wheel.

14. The method of claim 13 wherein each of the pusher elements has associated with it a pusher deflector.

15. The method of claim 13 wherein the actuation of the actuating buttons is carried out by pressing the buttons inward.

16. The method of claim 15 wherein the buttons are pressed more than once to dispense the material through the delivery opening.

17. The method of claim 13 wherein the material is a deodorant stick and after the material is dispensed through the delivery opening, the material is capable of being pushed back into the chamber when the actuating buttons and the pusher elements are in the end setting.

* * * * *